US012595026B1

(12) United States Patent
Esham

(10) Patent No.: US 12,595,026 B1
(45) Date of Patent: Apr. 7, 2026

(54) PATIO DIVE DOORS FOR MARINE VESSELS HAVING A SWIM STEP ASSEMBLY

(71) Applicant: Brunswick Corporation, Mettawa, IL (US)

(72) Inventor: Noah S. Esham, Edgewater, FL (US)

(73) Assignee: Brunswick Corporation, Mettawa, IL (US)

( * ) Notice: Subject to any disclaimer, the term of this patent is extended or adjusted under 35 U.S.C. 154(b) by 409 days.

(21) Appl. No.: 18/122,386

(22) Filed: Mar. 16, 2023

Related U.S. Application Data

(60) Provisional application No. 63/335,791, filed on Apr. 28, 2022.

(51) Int. Cl.
*B63B 27/14* (2006.01)

(52) U.S. Cl.
CPC ..... *B63B 27/146* (2013.01)

(58) Field of Classification Search
CPC ..... B63B 27/146
See application file for complete search history.

(56) References Cited

U.S. PATENT DOCUMENTS

| | | | |
|---|---|---|---|
| 2,158,949 | A | 5/1939 | Sarles et al. |
| 2,174,622 | A | 10/1939 | Dale |
| 2,493,639 | A | 1/1950 | Pellegrini |
| 2,809,849 | A | 10/1957 | Benne |
| 2,825,582 | A | 3/1958 | Mcdonald |
| 3,195,680 | A | 7/1965 | Thornburg, Sr. et al. |
| 3,394,947 | A | 7/1968 | Strube, Sr. |
| 3,462,170 | A | 8/1969 | Smith et al. |
| 3,501,190 | A | 3/1970 | Mccrea |
| 3,507,515 | A | 4/1970 | Brammer |
| 3,580,613 | A | 5/1971 | Northrop |
| 3,627,350 | A | 12/1971 | Cross |
| 3,716,254 | A | 2/1973 | Tarvin |
| 3,756,622 | A | 9/1973 | Pyle et al. |
| 3,774,720 | A | 11/1973 | Hovey |
| 3,799,288 | A | 3/1974 | Manuel et al. |

(Continued)

FOREIGN PATENT DOCUMENTS

| | | |
|---|---|---|
| CN | 105599867 | 5/2016 |
| CN | 206615350 U | 11/2017 |

(Continued)

OTHER PUBLICATIONS

Sheldon, U.S. Pat. No. 369,129; granted Aug. 30, 1887.

(Continued)

*Primary Examiner* — J. T. Newton
(74) *Attorney, Agent, or Firm* — Andrus Intellectual Property Law, LLP

(57) ABSTRACT

A marine vessel has a hull and a swim patio which is movable into a closed position in which the swim patio closes the hull and into an open position in which the swim patio provides platform on which a person can stand and dive into the water. The swim patio comprises a swim step assembly which is movable relative to the swim patio into and between a stowed position in which the swim step assembly is hidden in the swim patio and a deployed position in which the swim step assembly extends downwardly from the swim patio in the open position for the person to climb into or out of the water.

20 Claims, 7 Drawing Sheets

(56) References Cited

U.S. PATENT DOCUMENTS 3,825,097 A 7/1974 Owen
3,861,713 A 1/1975 Mckee
3,892,290 A 7/1975 Lang
3,927,903 A 12/1975 Jones
3,986,503 A 10/1976 Le Guillon
4,021,071 A 5/1977 Norman
4,174,115 A 11/1979 Youngblood
4,180,143 A 12/1979 Clugston
4,191,388 A 3/1980 Barksdale
4,194,754 A 3/1980 Hightower
4,198,070 A 4/1980 Weiler
4,275,664 A 6/1981 Reddy
4,293,967 A 10/1981 Ord
4,391,453 A 7/1983 Glaser
4,432,436 A 2/1984 Suiter
4,462,485 A 7/1984 Terry et al.
4,556,125 A 12/1985 Johnson
4,605,098 A 8/1986 Leuty
4,623,160 A 11/1986 Trudell
4,712,503 A 12/1987 Ritten
4,722,419 A 2/1988 Hoszowski
4,724,925 A 2/1988 Ritten
4,726,317 A 2/1988 Ritten et al.
4,733,752 A 3/1988 Sklar
4,742,795 A 5/1988 Deprey et al.
4,750,753 A 6/1988 Dezern
4,799,447 A 1/1989 Hebert et al.
4,819,987 A 4/1989 Stringer
4,823,910 A 4/1989 Day
4,846,487 A 7/1989 Criley
4,907,673 A 3/1990 Ginter et al.
4,926,965 A 5/1990 Fox
4,930,797 A 6/1990 Parrill
4,993,109 A 2/1991 Stevens
5,014,640 A 5/1991 Owen, Sr.
5,028,063 A 7/1991 Andrews
5,039,119 A 8/1991 Baughman
5,085,164 A 2/1992 Whitton
5,123,372 A 6/1992 Kobayashi et al.
5,152,244 A 10/1992 Jarmillo, Jr. et al.
5,222,456 A 6/1993 Friedrich
5,294,175 A 3/1994 Elton
5,435,260 A 7/1995 Granie et al.
5,458,080 A 10/1995 Jaramillo, Sr.
5,537,949 A 7/1996 Blevins et al.
5,549,312 A 8/1996 Garvert
5,560,679 A 10/1996 Barnholdt
5,572,944 A 11/1996 Slikkers et al.
5,584,733 A 12/1996 Kobayashi
5,632,224 A 5/1997 Schneider
5,647,632 A 7/1997 Fireman
5,732,996 A 3/1998 Graffy et al.
5,788,311 A 8/1998 Tibbals
5,803,475 A 9/1998 Dick
5,927,433 A 7/1999 Jaramillo, Sr.
5,970,905 A 10/1999 Jaramillo, Sr.
5,970,906 A 10/1999 Hrescak et al.
6,019,050 A 2/2000 Ranta
6,021,733 A 2/2000 Jaramillo, Sr.
6,058,875 A 5/2000 Krish, Jr.
6,082,751 A 7/2000 Hanes et al.
6,119,809 A 9/2000 Mcclendon, Jr.
6,145,865 A 11/2000 Cannara et al.
6,170,093 B1 1/2001 Kowalski
6,170,842 B1 1/2001 Mueller
6,182,598 B1 2/2001 Bozzo
6,213,486 B1 4/2001 Kunz et al.
D445,076 S 7/2001 Weinerman
6,270,106 B1 8/2001 Maki et al.
6,327,992 B1 12/2001 Martin
6,533,303 B1 3/2003 Watson
6,578,510 B1 6/2003 Scruggs et al.
6,588,839 B1 7/2003 Salzer
6,631,938 B1 10/2003 Burns
6,793,039 B2 9/2004 Schmid, Jr.
6,904,863 B2 6/2005 Mardikian et al.
6,905,158 B1 6/2005 Bastian
6,942,272 B2 9/2005 Livingston
6,966,597 B2 11/2005 Tegtmeier
7,055,838 B2 6/2006 Lambie
7,059,648 B2 6/2006 Livingston
7,121,226 B2 10/2006 Grimaldi
7,162,969 B2 1/2007 Houlder et al.
7,182,175 B1 2/2007 Schmitt et al.
7,237,503 B2 7/2007 Stepp
7,314,019 B1 1/2008 Curi et al.
7,341,016 B2 3/2008 Terleski et al.
7,377,563 B1 5/2008 Demick
7,401,833 B2 7/2008 Dryja
7,410,031 B2 8/2008 Jensen
7,416,238 B2 8/2008 Houston
7,434,825 B2 10/2008 Williams
7,475,652 B2 1/2009 Dvorak
7,503,276 B1 3/2009 Curi et al.
7,607,400 B2 10/2009 Scotti
7,735,894 B2 6/2010 King et al.
7,766,357 B2 8/2010 Arvanites
7,896,419 B2 3/2011 Elliott et al.
7,900,575 B2 3/2011 Walbridge et al.
7,946,243 B1 5/2011 Ulrich
8,056,496 B1 11/2011 Bussa
8,075,008 B1 12/2011 Hanser et al.
D653,174 S 1/2012 Parvey
8,297,215 B1 10/2012 Chinn
8,375,880 B1 2/2013 St. Clair, Jr. et al.
8,434,420 B2 5/2013 Muller
8,444,225 B2 5/2013 Behe
8,479,677 B2 7/2013 Bolline et al.
8,522,922 B1 9/2013 Stokes
8,523,285 B2 9/2013 Wihinen
8,539,896 B2 9/2013 Bolline et al.
8,636,110 B2 1/2014 Ebbenga et al.
8,646,400 B2 2/2014 Grimaldi
8,671,869 B2 3/2014 Muller
D706,205 S 6/2014 Bradley
D710,288 S 8/2014 Dorton et al.
8,813,672 B2 8/2014 Nelson
D713,772 S 9/2014 Ziaylek et al.
8,833,290 B2 9/2014 Mueller
D717,713 S 11/2014 Whalen
8,899,169 B1 12/2014 Jaziri
8,905,354 B2 12/2014 Griffiths et al.
D726,635 S 4/2015 Curts
9,016,228 B2 4/2015 Dorton et al.
9,102,384 B2 8/2015 Pierce et al.
9,120,540 B1 9/2015 Foss et al.
D742,804 S 11/2015 Kim
9,205,896 B2 12/2015 Mueller
D748,561 S 2/2016 Canela
9,586,655 B1 3/2017 Butler
9,592,887 B2 3/2017 Frabetti
D806,625 S 1/2018 Hoffman et al.
9,937,979 B1 4/2018 Holmes
9,944,360 B2 4/2018 Franklin
10,017,235 B2 7/2018 Pappas et al.
10,086,913 B2 10/2018 Fafard
10,106,227 B2 10/2018 Allender
D833,358 S 11/2018 Lu
10,308,320 B1 6/2019 O'Neal
10,351,215 B2 7/2019 Scozzoli
10,399,645 B1 * 9/2019 Holmes ..... B63B 27/146
10,501,151 B2 12/2019 Allender
D877,302 S 3/2020 Hyde
10,703,446 B2 7/2020 Ricciardi et al.
D896,459 S 9/2020 Eilmus et al.
10,822,059 B2 11/2020 Miller
11,401,011 B2 8/2022 Johns
11,932,356 B1 * 3/2024 Ramsdell ..... B63B 27/146
12,357,097 B1 * 7/2025 Esham ..... A47C 7/48
2002/0003340 A1 1/2002 Hallquist
2002/0038623 A1 * 4/2002 Irish ..... B63B 35/42
114/259
2002/0070577 A1 6/2002 Pool et al.
2003/0070875 A1 4/2003 Medsker

(56) References Cited

U.S. PATENT DOCUMENTS

| | | | | |
|---|---|---|---|---|
| 2003/0178252 | A1* | 9/2003 | Schmid, Jr. | E04H 4/144 182/84 |
| 2004/0144296 | A1* | 7/2004 | Houlder | B63B 27/14 114/343 |
| 2004/0160079 | A1 | 8/2004 | Harper et al. | |
| 2004/0256833 | A1 | 12/2004 | Cervenka | |
| 2005/0046219 | A1 | 3/2005 | Livingston | |
| 2006/0137594 | A1* | 6/2006 | Stepp | B63B 29/20 114/364 |
| 2008/0277958 | A1 | 11/2008 | King et al. | |
| 2009/0078188 | A1 | 3/2009 | Thomas | |
| 2010/0089697 | A1 | 4/2010 | Kreller | |
| 2010/0170430 | A1 | 7/2010 | Gros | |
| 2010/0288179 | A1 | 11/2010 | Grimaldi | |
| 2011/0023770 | A1 | 2/2011 | Brown | |
| 2012/0032418 | A1 | 2/2012 | Doucette et al. | |
| 2012/0032490 | A1 | 2/2012 | Nowak et al. | |
| 2013/0000542 | A1* | 1/2013 | Muller | B63B 27/30 114/362 |
| 2013/0024074 | A1 | 1/2013 | Baur et al. | |
| 2013/0025524 | A1 | 1/2013 | Cooney | |
| 2013/0160695 | A1* | 6/2013 | Gratz | B63B 29/02 114/362 |
| 2015/0217835 | A1* | 8/2015 | Gasper | B63B 34/40 114/280 |
| 2019/0084655 | A1* | 3/2019 | Scozzoli | B63B 27/36 |
| 2019/0233998 | A1 | 8/2019 | Maynes | |
| 2020/0055572 | A1 | 2/2020 | Ricciardi et al. | |
| 2020/0055573 | A1 | 2/2020 | Miller | |
| 2021/0047005 | A1* | 2/2021 | Fafard | B63B 27/146 |

FOREIGN PATENT DOCUMENTS

| | | |
|---|---|---|
| DE | 1077096 | 3/1960 |
| DE | 7401974 U | 4/1974 |
| DE | 202009007140 | 9/2009 |
| DE | 102008057537 | 5/2010 |
| DE | 102018133044 | 6/2020 |
| EP | 1216918 | 6/2002 |
| EP | 2065301 | 6/2009 |
| EP | 3578452 | 12/2019 |
| EP | 3290326 | 1/2020 |
| EP | 3771631 | 2/2021 |
| FR | 2235040 | 1/1975 |
| FR | 2601643 A1 | 1/1988 |
| FR | 2603236 | 3/1988 |
| FR | 2689085 | 10/1993 |
| GB | 254090 | 7/1926 |
| GB | 2476469 | 6/2011 |
| WO | 2007087736 | 8/2007 |
| WO | 2009077787 | 6/2009 |
| WO | 2011137548 | 11/2011 |
| WO | 2013036940 | 3/2013 |
| WO | 2014199314 | 12/2014 |
| WO | 2016089333 | 6/2016 |
| WO | 2017187369 | 11/2017 |

OTHER PUBLICATIONS

Bayliner 185, 195, 205, & 225 Runabouts Owner's Manual Supplement, published 2006.

Four Winns Express Cruisers 2006, retrieved from https://web.archive.org/web/20140712184107/http://fourwinns.com/upload/Documents/Catalogs/2006/Four-Winns-Cruisers-Catalog.pdf on Mar. 13, 2023.

Four Winns Passion for Water: 2009 Sport Boats & Sport Cruisers; retrieved from https://web.archive.org/web/20140712174326/http://fourwinns.com/upload/Documents/Catalogs/2009/Four-Winns-Sport-Boats-Catalog.pdf on Mar. 13, 2023.

Munson Bow Door Options, retrieved from https://web.archive.org/web/20150224171602/http://munsonboats.com/bowdoors.php on Mar. 13, 2023.

Diving Equipment Specialties: Dive Ladders; retrieved from http://www.techdivetools.com/boat/ladders.html on Mar. 13, 2023.

Swim-Platform; retrieved from https://web.archive.org/web/20080603024024/http://www.swim-platform.com/ on Mar. 13, 2023.

Intrepid 327CC; retrieved from https://www.intrepidpowerboats.com/boats/327-valor/ on Mar. 15, 2023.

Cobalt Innovation—The Swim Stem, announced in YouTube on Nov. 10, 2010 [online], [site visited Apr. 13, 2023], Available from the internet URL: https://www.youtube.com/watch?v=VpmcKS_ytfg.

Motorized Swim Platform + Furry friends = Score!, announced in YouTube on Mar. 28, 2020 [online], [site visited Apr. 13, 2023], Available from the internet URL:https://www.youtube.com/watch?v=M96dosSTLFY.

Swim Platform UTRA—Brand New Built-in Retractable Bench!, announced in YouTube on Mar. 12, 2018 [online], [site visited Apr. 13, 2023], available from the internet URL:https://www.youtube.com/watch?v=dRHH4rTha7U.

Unpublished U.S. Appl. No. 17/350,555.

* cited by examiner

PATIO DIVE DOORS FOR MARINE VESSELS HAVING A SWIM STEP ASSEMBLY

CROSS-REFERENCE TO RELATED APPLICATION

The present application claims priority to U.S. Provisional Patent Application No. 63/335,791, filed Apr. 28, 2022, which is hereby incorporated herein by reference.

FIELD

The present disclosure relates to marine vessels and to dive doors for marine vessels.

BACKGROUND

The following U.S. Patents are incorporated herein by reference in entirety.

U.S. Pat. No. 9,120,540 discloses a dive door for a marine vessel, the dive door having a planar body having an interior surface and an exterior surface. The door is disposed between the gunwale of the boat and is hingeably attached to the deck of the boat. The door is releasably retained to the gunwale by one or more latches disposed at a top edge of the dive door. One or more gas shocks are attached to the door and the boat so that the dive door is selectively operable between a deployed position and a closed position. When deployed, the interior surface of the dive door extends outwardly from the boat. In the closed position, the outer surface of the dive door matches the profile of the gunwale, providing a sleek integrated look. A ladder may be hinged to the dive door and is configured to extend downward into the water surface when the door is deployed.

U.S. Pat. No. 10,106,227 discloses a bulwark terrace with integrated door. The bulwark terrace is a portion of a bulwark on a ship or yacht which is hinged so as to be able to fold outwards and downwards and be flush with the deck after doing so, thereby extending the deck surface. The bulwark terrace also includes a door which may open independently of the bulwark terrace to allow boarding of the yacht or ship through the bulwark without deploying the bulwark terrace.

SUMMARY

This Summary is provided to introduce a selection of concepts which are further described below in the Detailed Description. This Summary is not intended to identify key or essential features of the claimed subject matter, nor is it intended to be used as an aid in limiting the scope of the claimed subject matter.

A marine vessel has a hull and a swim patio which is movable into a closed position in which the swim patio closes the hull and into an open position in which the swim patio provides platform on which a person can stand and dive into the water. The swim patio comprises a swim step assembly which is movable relative to the swim patio into and between a stowed position in which the swim step assembly is hidden in the swim patio and a deployed position in which the swim step assembly extends downwardly from the swim patio in the open position for the person to climb into or out of the water.

In non-limiting examples, the swim patio is pivoted by an actuator about its lower end into the closed position and into the open position. The swim patio comprises an inner hull sidewall which is pivotable relative to the hull into the closed position and the open position, the inner hull sidewall providing the platform in the open position. A frame assembly connects the inner hull sidewall to the outer hull sidewall and in the stowed position is entirely hidden in the swim patio. The frame assembly is retractable and extendable to position the swim step assembly in the stowed position and the deployed position, respectively.

In non-limiting examples, the outer hull sidewall in the deployed position provides a lower swim step of the swim step assembly. An intermediate swim step is located between the platform and the lower swim step. The frame assembly in the stowed position is enclosed in a cavity which is at least partially defined by the inner hull sidewall and the outer hull sidewall. The frame assembly comprises a base frame which is fixed to the inner hull sidewall and frame linkage which is pivotably coupled to the base frame and pivotably coupled to the outer hull sidewall.

BRIEF DESCRIPTION OF THE DRAWINGS

The present disclosure includes the following Figures.

DETAILED DESCRIPTION

Figure 1:
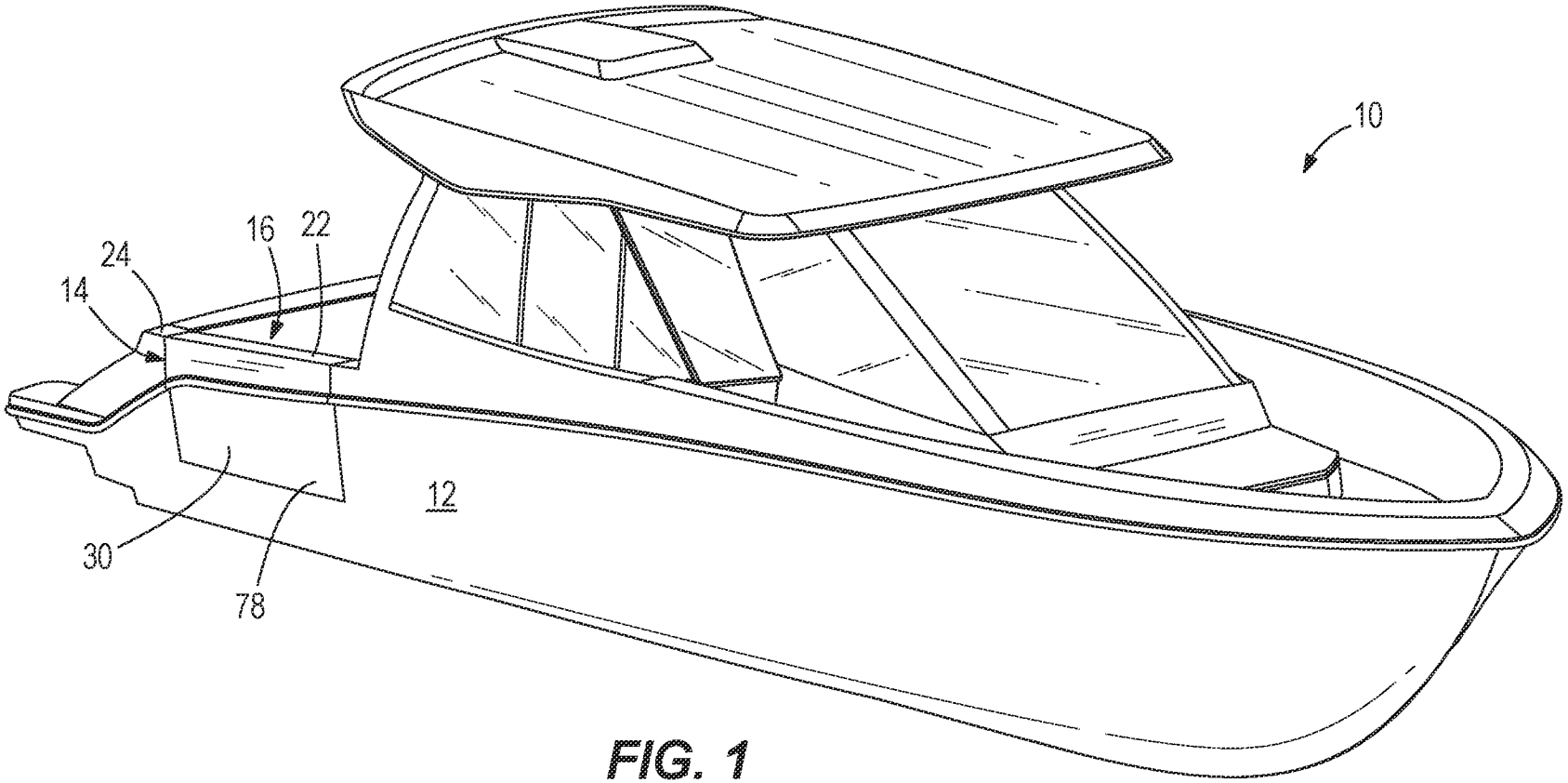
FIG. 1 is a perspective view of a marine vessel having a dive patio according to the present disclosure.
Figure 2:
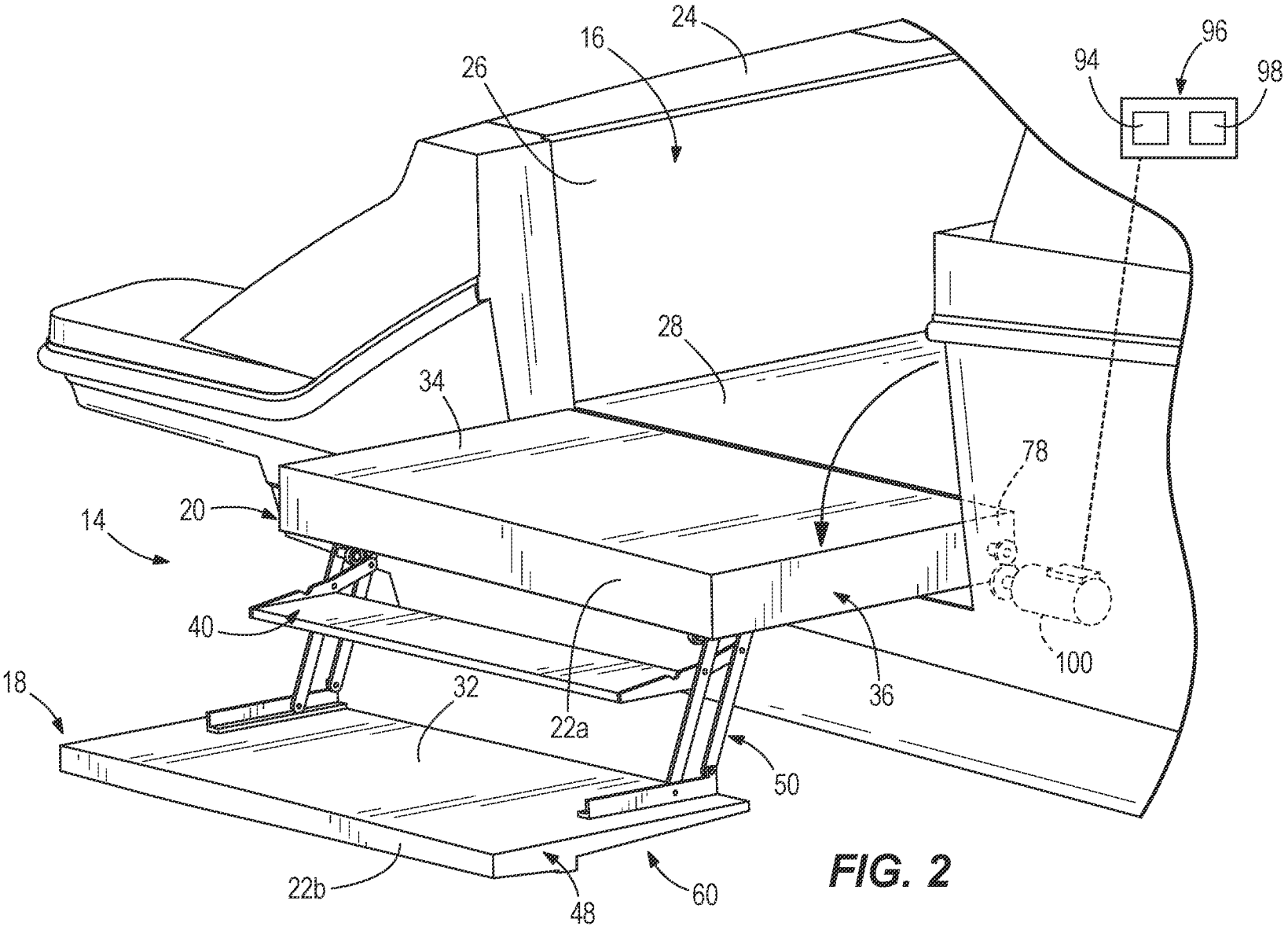
FIG. 2 is a perspective view of the dive patio and a swim step assembly in an open-deployed state.

FIGS. 1-2 show a marine vessel 10 which includes a hull 12, and a swim patio 14 configured such that the hull 12 and swim patio 14 together define sidewalls 16 about the periphery of the vessel 10. The sidewalls 16 have gunwales 24 and an inner face 26 which terminates at a deck 28. A patio actuator 100 is provided for automatically pivoting the swim patio 14 about its lower end 78 between an open position (FIG. 2) and a closed position (FIG. 1). The type and configuration of patio actuator 100 can vary according to conventionally known actuators. The non-limiting example shown is a bi-directional electric motor having an output gear which is rotationally engaged with an input gear on the lower end 78 of the swim patio 14, in particular such that operation of the electric motor in a first direction rotates the output gear in the first direction, which in turn rotates the input gear and pivots the swim patio 14 into the open position shown in FIG. 2. Conversely, operation of the electric motor in an opposite, second direction rotates the output gear in an opposite, second direction, which in turn rotates the input gear and pivots the swim patio 14 into the closed position shown in FIG. 1. Again, the type and configuration of the patio actuator 100 is merely exemplary. Other suitable examples include conventional hydraulic actuators and/or electro-hydraulic actuators.

Referring to FIG. 2, swim patio 14 has an inner hull sidewall 20 coupled to an outer hull sidewall 18 via a frame assembly 50. In some examples, the patio 14 further includes an intermediate swim step 40, disposed between the outer hull sidewall 18 and the inner hull sidewall 20 and connected via the frame assembly 50. Together, the inner hull sidewall 20, the frame assembly 50, the intermediate swim step 40, and the outer hull sidewall 18 constitute a swim step assembly 60, which is movable into and between a stowed position (FIG. 1) and a deployed position (FIG. 2). As will be further described herein below, the swim patio 14 including the swim step assembly 60 which is movable into one of three states: a closed-stowed state (FIG. 1), an open-stowed state (FIG. 5), and an open-deployed state (FIGS. 2, 3, 4, 7).

Figure 3:
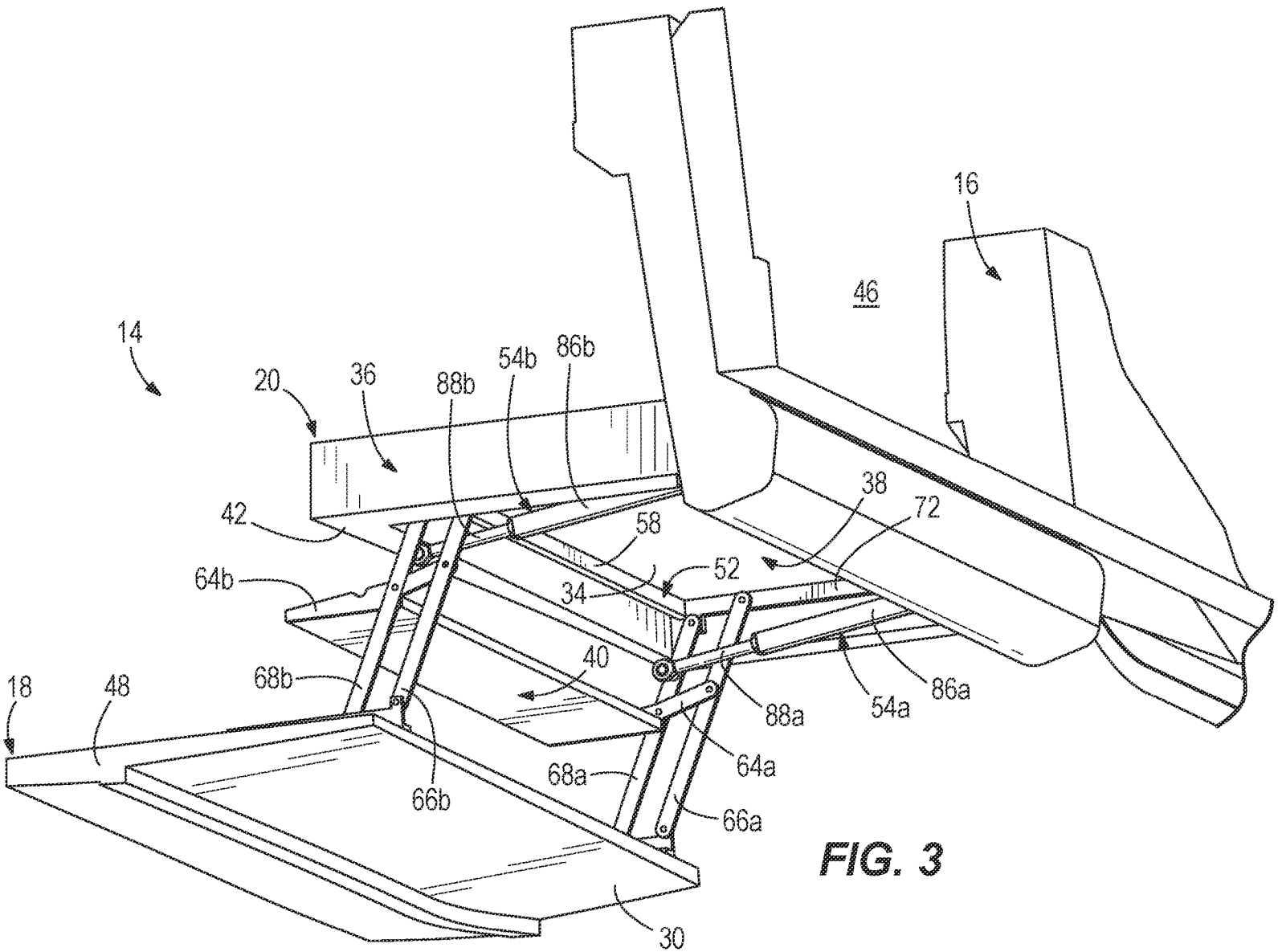
FIG. 3 is a view of the underside of the dive patio and swim step assembly in the open-deployed state.

Referring to FIGS. 2-3, inner hull sidewall 20 has an inner hull wall 34, and four sidewalls 36 each having an outward surface 42. Together the inner hull wall 34 and the four sidewalls 36 define an inner storage cavity 38. The four sidewalls 36 define a depth of the storage cavity 38 and include a gunwale surface 22*a* which aligns with the gunwales 24 of the vessel 10 when the patio 14 is in the closed position.

Figure 4:
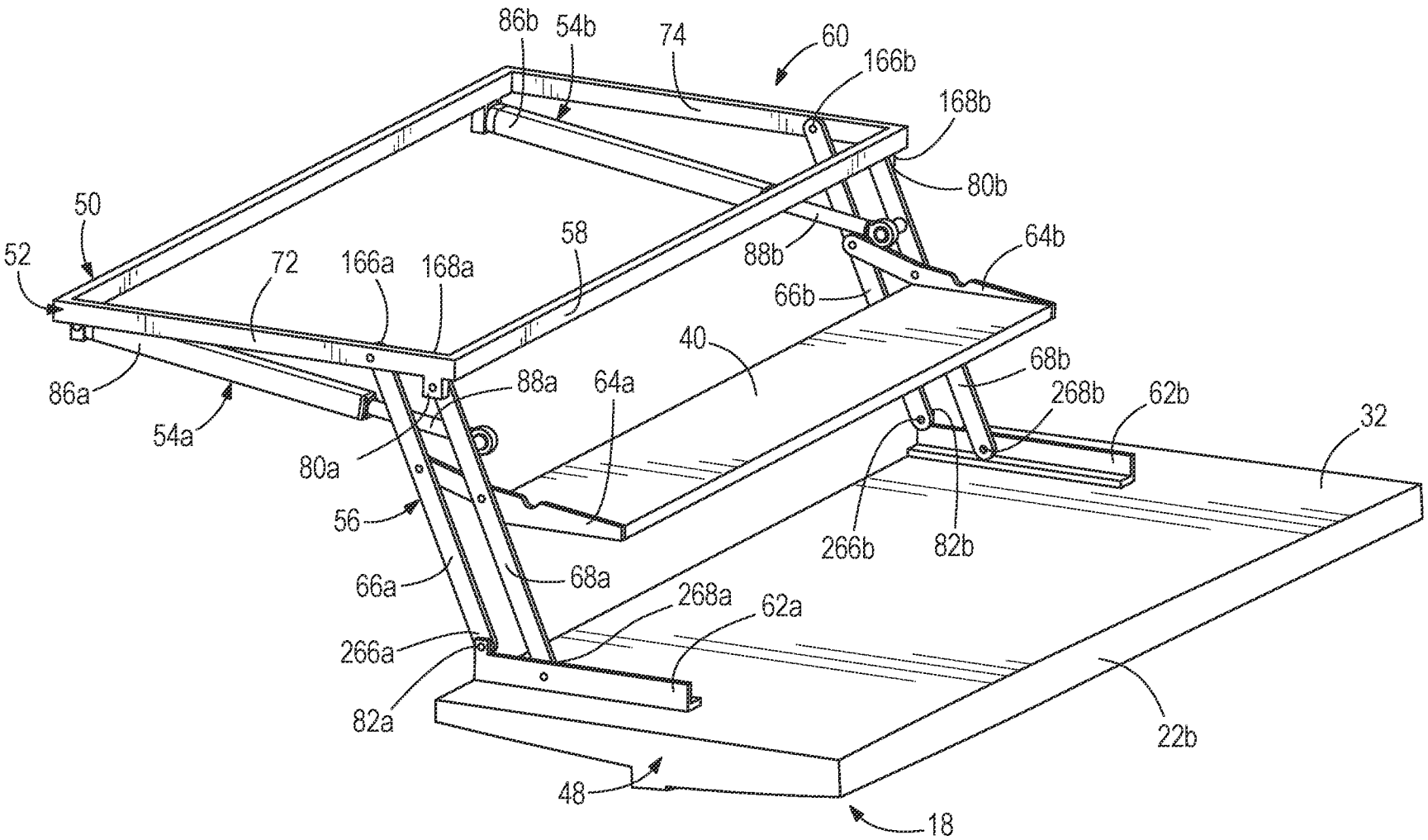
FIG. 4 is a view of the swim step assembly in a deployed position.

Referring to FIGS. 3 and 4, the outer hull sidewall 18 has an outer hull face 30, sides 48 and an inner step face 32. The sides 48 vary in thickness along their length such that the outer hull sidewall 18 has a profile which matches and is flush with the profile of the hull 12 when the swim patio 14 is in the closed position. The sides 48 include a gunwale surface 22*b* which aligns with the gunwales 24 and abuts the gunwale surface 22*a* of the inner hull sidewall 20 when the patio 14 is in a closed position.

Referring to FIG. 4, the inner hull sidewall 20 is connected to the inner step face 32 of the outer hull sidewall 18 via the frame assembly 50. The frame assembly 50 includes a rectangular base frame 52, a first and second set of parallel link arms 56, and opposing L-brackets 62*a*, 62*b*. The base frame 52 is fixed to the inner hull sidewall 20 at the base of the storage cavity 38 defined by the four sidewalls 36. The frame assembly 50 is pivotably coupled to the outer hull sidewall 18 via the opposing L-brackets 62*a*, 62*b* positioned on either side of the inner step face 32. Each of the L-brackets 62*a*, 62*b* has a projection 82*a*, 82*b* at a location distal the gunwale surface 22*b*.

The base frame 52 has a back end 70, a front end 58, a left side 72, and a right side 74. The left side 72 and right side 74 each have a projection 80*a*, 80*b* proximate the front end 58. The first set of parallel link arms 56 has two link arms 66*a*, 68*a*. The second set of parallel link arms 56 has two link arms 66*b*, 68*b*. Each of the link arms 66*a*, 68*a*, 66*b*, 68*b* have a first end 166*a*, 168*a*, 166*b*, 168*b* and a second end 266*a*, 268*a*, 266*b*, 268*b*, respectively. The link arms 66*a* and 68*a* are positioned on the left side 72 of the base frame 52 proximate the front end 58. The link arms 66*b* and 68*b* are positioned on the right side 74 of the base frame 52 proximate the front end 58.

The link arms 66*a*, 68*a*, 66*b*, 68*b* are pivotably coupled to the base frame 52 at the first ends 166*a*, 168*a*, 166*b*, 168*b*. The link arms 66*a*, 68*a* are coupled to the L-bracket 62*a* at the second ends 266*a*, 268*a*, and the link arms 66*b*, 68*b* are coupled to the L-bracket 62*b* at the second ends 266*b*, 268*b*. Each of the link arms 66*a*, 66*b*, and 68*a*, 68*b* are coupled at locations on the base frame 52 and L-brackets 62 which permit the parallel link arms 56 to collapse entirely without interference. The first end 166*a* of the link arm 66*a* is coupled to the left side 72 of the base frame 52 and the second end 266*a* is coupled to the projection 82*a* on the L-bracket 62*a*. The first end 168*a* of the link arm 68*a* is coupled to the projection 80*a* on the left side 72 of the base frame 52 and the second end 268*a* is coupled to the L-bracket 62*a*. The first end 166*b* of the link arm 66*b* is coupled to the right side 74 of the base frame 52 and the second end 266*b* is coupled to the projection 82*b* on the L-bracket 62*b*. The first end 168*b* of the link arm 68*b* is coupled to the projection 80*b* on the right side 74 of the base frame 52 and the second end 268*b* is coupled to the L-bracket 62*b*.

In examples wherein the swim patio 14 includes an intermediate swim step 40, the frame assembly 50 further includes opposing support brackets 64*a*, 64*b*. The intermediate swim step 40 is coupled to the frame assembly 50 via the opposing support brackets 64*a*, 64*b* positioned on either side of the intermediate swim step 40. The link arms 66*a*, 68*a* are coupled to the support bracket 64*a* at a location disposed between the first ends 166*a*, 168*a* and the second ends 266*a*, 268*b*, and the link arms 66*b*, 68*b* are coupled to the support bracket 64*b* at a location disposed between the first ends 166*b*, 168*b* and the second ends 266*b*, 268*b*.

Referring to FIGS. 3-4, patio 14 has first and second swim step actuators 54*a*, 54*b* coupled to the base frame 52 and positioned within the storage cavity 38. The swim step actuators 54*a*, 54*b* are arranged such that one is positioned proximate the left side 72 of the base frame 52 and one proximate the right side 74, respectively. In the illustrated example, the step actuators 54*a*, 54*b* are hydraulic, linear actuators each having an actuation body 86*a*. 86*b* and an actuation arm 88*a*, 88*b*. The actuation bodies 86*a*, 86*b* of the respective step actuators 54*a*, 54*b* are coupled to either side of the base frame 52 at the back end 70. The actuation arms 88*a*, 88*b* extend from the actuation bodies 86*a*, 86*b* and are pivotably coupled to the parallel link arms 56 at an opposite end. The link arm 68*a* is pivotably coupled to the actuation arm 88*a* at a location disposed between the first ends 166*a*, 168*a* and the support bracket 64*a*. The link arm 68*b* is coupled to the actuation arm 88*b* at a location disposed between the first ends 166*b*, 168*b* and the support bracket 64*b*.

The type and configuration of the swim step actuators 54 is merely exemplary, and other actuators including electro-hydraulic actuators and/or the like are viable alternatives. As further explained below, the step actuators 54 are controllable to cause movement of the parallel link arms 56 and extension and retraction of the swim step assembly 60. The first and second step actuators 54*a*, 54*b* are configured to move at the same speed and in the same direction, simultaneously, so that the intermediate swim step 40 and outer hull sidewall 18 maintain a constant, horizontal orientation during deployment and retraction.

The patio actuator 100 and the swim step actuators 54 are controlled by one or more user input devices 96, shown in FIGS. 2, and 5-7. The user input device can include manually operable electro-mechanical switches located within the vessel 10 and communicatively connected by wired or wireless link to the patio actuator 100, and swim step actuators 54. In one example, the user input device includes a patio switch 94 and a swim step switch 98, each movable into a first and second position. Actuation of the patio switch 94 into the first or the second position causes the input gear of patio actuator 100 patio 14 to rotate in the first or the second direction, pivoting the patio 14 into the open or the closed position, respectively. Activation of the swim step switch 98 into the first or the second position causes the linear swim step actuators 54 to extend or retract the actuation arms 88, causing the swim step assembly 60 to move into the deployed or the stowed position, respectively. In this configuration, the swim step switch 98 is not operable when the patio 14 is in the closed position. In an alternative example, the user input device 96 includes a three-way switch, wherein moving the respective switch into a first position causes the patio 14 to move into the closed-stowed state, moving the respective switch into a different second position causes the patio 14 to move into the open-stowed state, and moving the respective switch into a different third position causes the patio 14 to move into the open-deployed state. Alternative user input devices can be used, the user input device 96 described herein is merely exemplary.

Utilizing the user input device 96, the user can cause the patio 14 to move into one of the three states: the closed-stowed state, the open-stowed state, and the open-deployed state, as shown in FIGS. 1, and 5-7. Upon selection of the desired state, the patio actuator 100 and/or swim step actuators 54 are initiated to move the patio 14 and/or swim step assembly 60 into the appropriate position.

In the closed-stowed state, as shown in FIG. 1, the swim patio 14 closes the hull 12. In the stowed position, the actuation arms 88 are retracted, such that the parallel link arms 56 and intermediate swim step 40 are collapsed in an accordion fashion and the inner step face 32 of the outer hull sidewall 18 abuts the outward surface 42 of the inner hull sidewall 20, closing the storage cavity 38 so that the frame assembly 50 and intermediate swim step 40 are fully hidden within. Furthermore, the outer hull face 30 of the outer hull sidewall 18 aligns flush with and closes the hull 12 and the border face 22 of the patio 14 aligns flush with and closes the gunwales 24 of the sidewalls 16.

Figure 5:
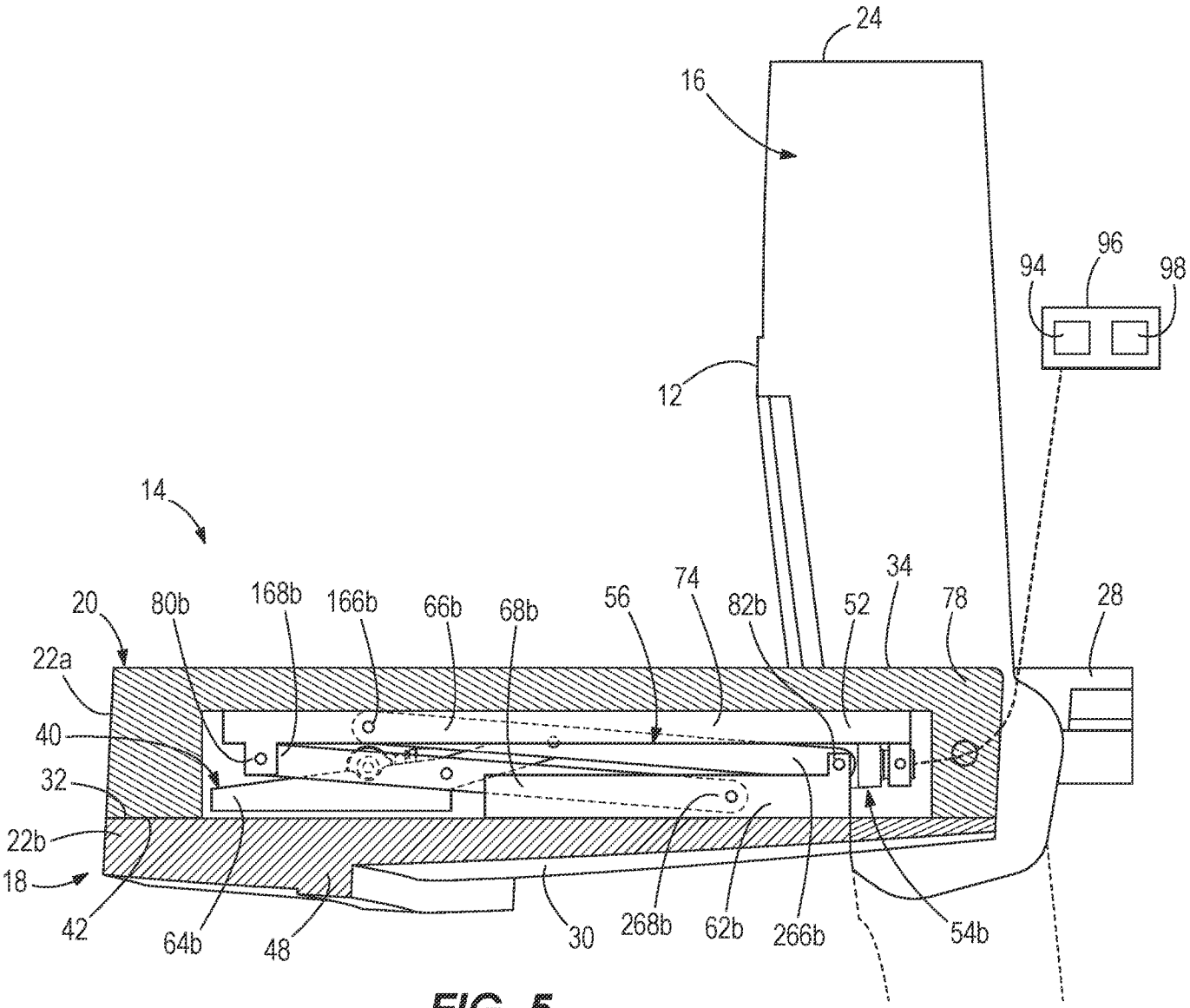
FIG. 5 is a side view of the dive patio in an open-stowed state.

In the open-stowed state, as shown in FIG. 5, the swim patio 14 is pivoted 90 degrees downward relative to the hull 12 about the lower end 78 of the inner hull sidewall 20 via the patio actuator 100. When pivoted 90 degrees, a passage 46 is revealed in the hull 12 and the inner hull wall 34 of the inner hull sidewall 20 aligns flush with the deck 28, providing a safe, level walkway for passengers and a platform to stand and dive off of. As previously described, the stowed state entails that the entire frame assembly 50 and intermediate swim step 40 are completely hidden within the storage cavity 38 of the inner hull sidewall 20. Shown most clearly in FIG. 5, the parallel link arms 56, L-brackets 62, intermediate swim step 40, support brackets 64, and step actuators 54 are sized and shaped to allow the frame assembly 50 to collapse entirely upon itself without interference. Furthermore, as discussed above, the coupling of the parallel link arms 56 at offset locations relative the base frame 52 and L-brackets 62 permit compact storage of the intermediate swim step 40 and frame assembly 50.

Figure 6:
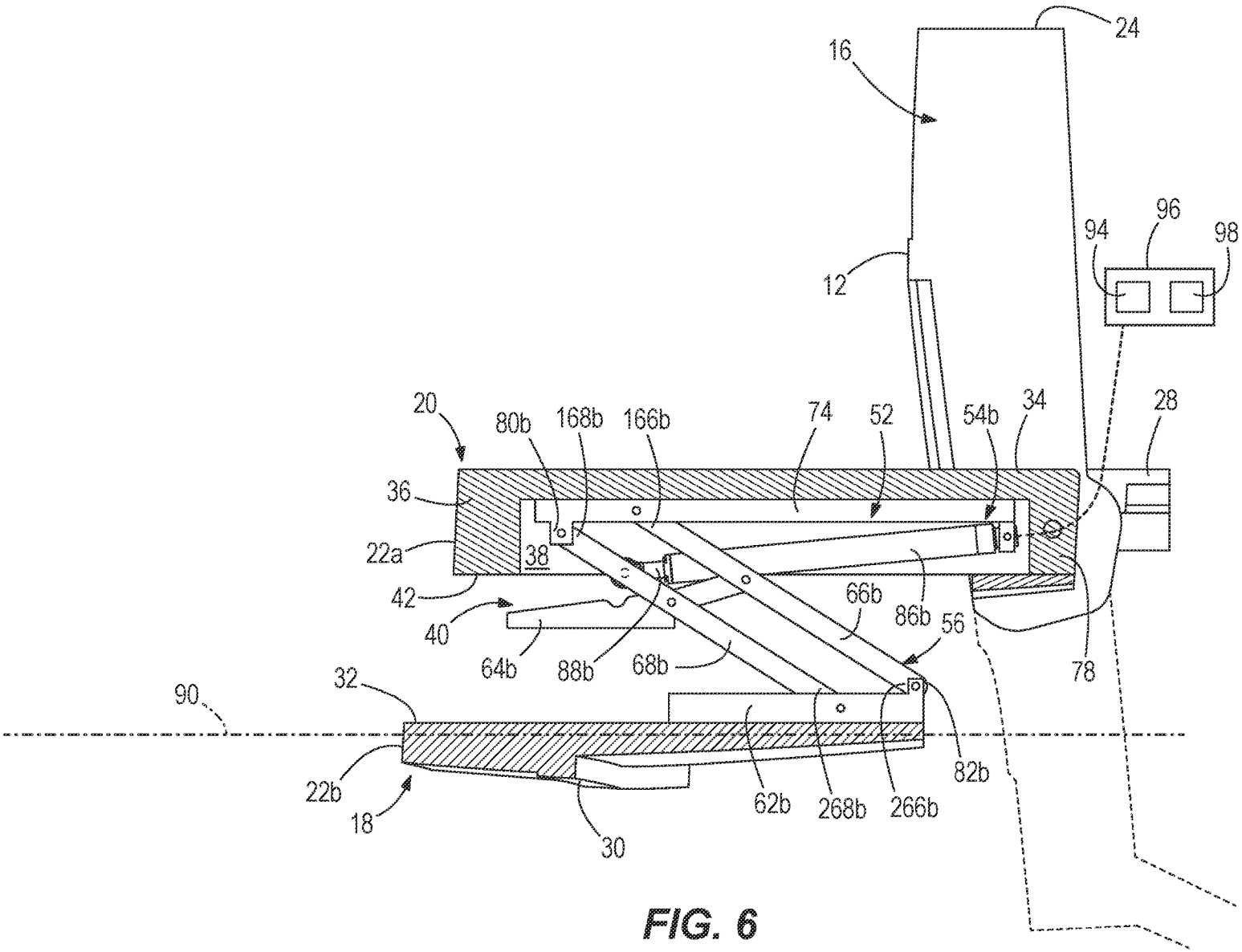
FIG. 6 is a side view of the dive patio during swim step assembly deployment.
Figure 7:
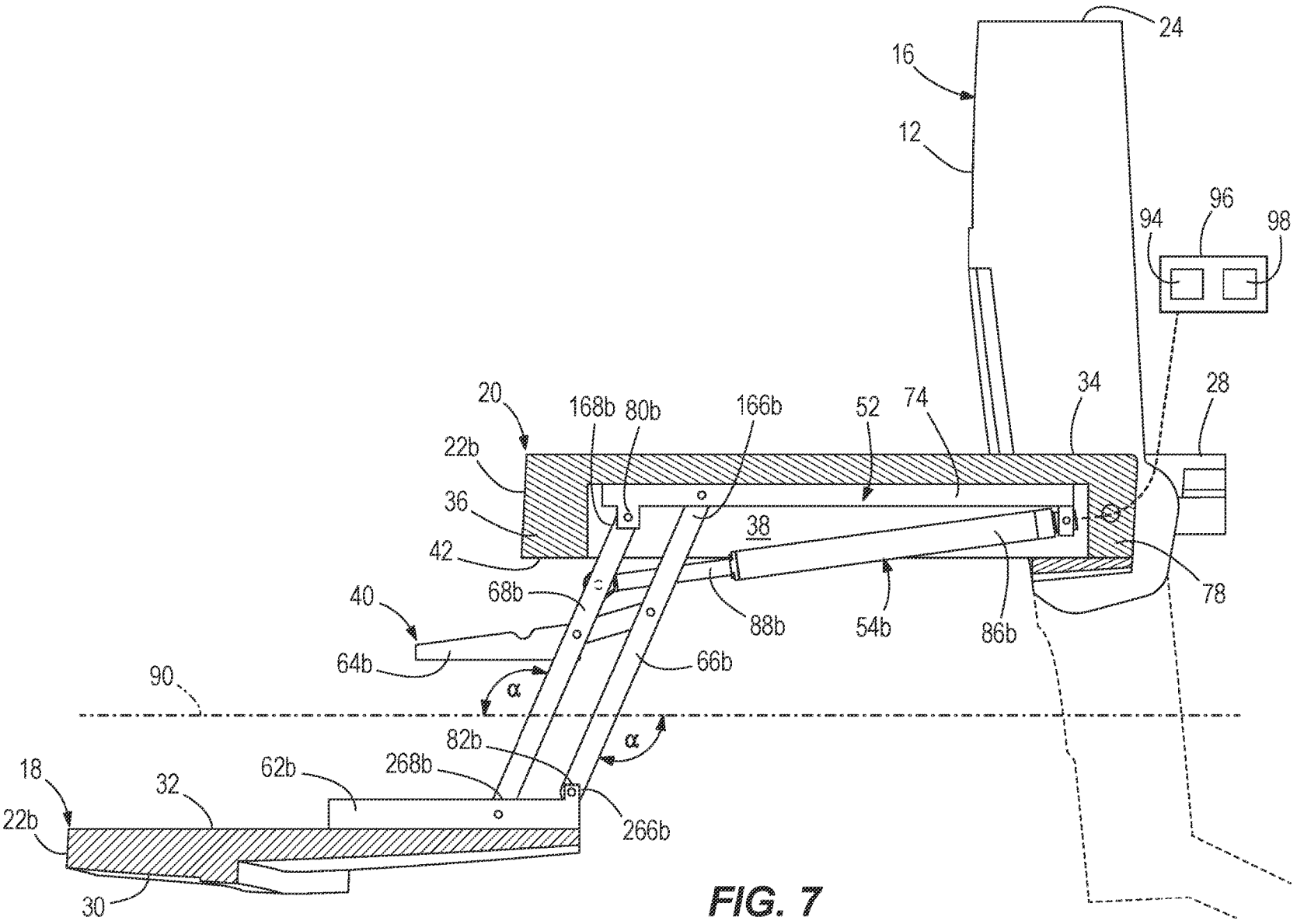
FIG. 7 is a side view of the dive patio in the open-deployed state.

Between the open-stowed state and the open-deployed state is the deployment of the swim step assembly 60, as shown in FIGS. 5-7. During deployment, the actuation arms 88*a*, 88*b* extend outward, applying a force on the link arms 68*a*, 68*b*, rotating them outward relative to the hull 12. During this rotation, the intermediate swim step 40 and the outer hull sidewall 18 are maintained in a horizontal orientation via the parallel link arms 56 as they are lowered toward a water surface 90 and moved outward relative to the hull 12.

In the open-deployed state, as shown primarily in FIGS. 2 and 7, the swim step actuators 54 are held in a fully extended position, with the actuation arms 88 maintaining the parallel link arms 56 at an obtuse angle $\alpha$ relative the water surface 90. The outer hull sidewall 18 is held below the water surface 90, and the inner step face 32 acts as a stepping surface for passengers, providing easy passage into and out of the water. In some examples, the intermediate swim step 40 acts as an additional stepping surface for passengers, and in additional examples, intermediate swim step 40 includes multiple steps. The illustrated example described herein is not limiting. The swim step assembly 60 could be configured to be deployed to a variety of heights and angles relative to the water surface 90.

The present disclosure provides a substantial improvement of existing dive patios provided on marine vessels in the prior art. Most notably, current integrated vessel hull side dive patios do not provide adequate access to the water without the use of a detachable ladder or other boarding devices. Usually, these dive patios sit significantly above the vessel waterline, when fully deployed, making vessel reboarding challenging. By providing an automatically deployable submersible swim step assembly within the swim patio, the present disclosure satisfies a need for reboarding assistance, as well as maintains a sleek, integrated design for the vessel itself.

This written description uses embodiments to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other embodiments which occur to those skilled in the art. Such other embodiments are intended to be within the scope of the claims if they have features or structural elements which do not differ from the literal language of the claims, or if they include equivalent features or structural elements with insubstantial differences from the literal languages of the claims.

What is claimed is:

1. A marine vessel for operating in a body of water, the marine vessel comprising:

a hull; and a swim patio having a swim step assembly, wherein the swim patio is movable into a closed position in which the swim patio closes the hull and into an open position in which the swim patio provides a platform on which a person can stand and dive into the water, wherein the swim step assembly comprises an inner hull sidewall and an outer hull sidewall moveably coupled to the inner hull sidewall, wherein the swim step assembly is movable relative to the swim patio into and between a stowed position in which the outer hull sidewall is proximate the inner hull sidewall and a deployed position in which the outer hull sidewall moves from the swim patio in the open position for the person to climb into or out of the water, wherein the inner hull sidewall and the outer hull sidewall are substantially parallel to each other when the swim step assembly is in the stowed position and in the deployed position.

2. The marine vessel according to claim 1, wherein the swim patio is pivotable into the closed position and into the open position.

3. The marine vessel according to claim 2, wherein the swim patio comprises a lower end and wherein the swim patio pivots about the lower end.

4. The marine vessel according to claim 3, further comprising an actuator configured to automatically pivot the swim patio into the closed position and the open position.

5. The marine vessel according to claim 2, wherein the inner hull sidewall is pivotable relative to the hull into the closed position and the open position, the inner hull sidewall providing the platform in the open position.

6. The marine vessel according to claim 5, wherein the swim step assembly comprises a frame assembly which in the stowed position is entirely hidden in the swim patio.

7. The marine vessel according to claim 6, wherein the outer hull sidewall is coupled to the inner hull sidewall by the frame assembly, and wherein the frame assembly is retractable and extendable to position the swim step assembly in the stowed position and the deployed position, respectively.

8. The marine vessel according to claim 7, wherein the frame assembly in the stowed position is enclosed in a cavity which is at least partially defined by the inner hull sidewall and the outer hull sidewall.

9. The marine vessel according to claim 7, wherein the frame assembly comprises a base frame which is fixed to the inner hull sidewall and frame linkage which is pivotably coupled to the base frame and pivotably coupled to the outer hull sidewall.

10. The marine vessel according to claim 7, further comprising an actuator configured to automatically move the swim step assembly into the stowed position and the deployed position.

11. The marine vessel according to claim 10, wherein the actuator comprises a hydraulic actuator.

12. The marine vessel according to claim 10, wherein the actuator comprises a linear actuator.

13. The marine vessel according to claim 1, wherein the swim patio in the stowed position is flush with the hull.

14. The marine vessel according to claim 13, wherein the inner hull sidewall is pivotable relative to the hull into the closed position and the open position, the inner hull sidewall providing the platform in the open position and wherein the swim step assembly comprises a frame assembly which in the stowed position is entirely hidden in the swim patio.

15. The marine vessel according to claim 13, wherein the inner hull sidewall is pivotable relative to the hull into the closed position and the open position, the inner hull sidewall providing the platform in the open position, wherein the swim step assembly comprises a frame assembly which in the stowed position is entirely hidden in the swim patio, and wherein in the deployed position the outer hull sidewall provides a lower swim step of the swim step assembly.

16. The marine vessel according to claim 15, wherein the swim step assembly further comprises an intermediate swim step located between the platform and the lower swim step.

17. The marine vessel according to claim 15, wherein the frame assembly in the stowed position is fully enclosed in a cavity which is at least partially defined by the inner hull sidewall and the outer hull sidewall.

18. A marine vessel for operating in a body of water, the marine vessel comprising:

a hull; and a swim patio having a swim step assembly, wherein the swim patio is movable into a closed position in which the swim patio closes the hull and into an open position to provide a platform on which a person can stand and dive into the water, wherein the swim step assembly comprises an inner hull sidewall and an outer hull sidewall movably coupled to the inner hull sidewall, wherein the swim step assembly is movable relative to the swim patio into and between a stowed position in which the swim step assembly is at least partially hidden in the swim patio and a deployed position in which the swim step assembly extends downwardly from the swim patio in the open position for the person to climb into or out of the water, wherein the outer hull sidewall is unhidden when the swim patio is in both the stowed position and the deployed position, and wherein in the deployed position the outer hull sidewall provides a lower swim step of the swim step assembly.

19. The marine vessel according to claim 18, wherein the swim step assembly further comprises an intermediate swim step located between the platform and the lower swim step.

20. A marine vessel for operating in a body of water, the marine vessel comprising:

a hull; and a swim patio having a swim step assembly, wherein the swim patio is movable into a closed position in which the swim patio closes the hull and into an open position to provide a platform on which a person can stand and dive into the water, wherein the swim step assembly comprises an inner hull sidewall and an outer hull sidewall movably coupled to the inner hull sidewall, wherein the swim step assembly is movable relative to the swim patio into and between a stowed position in which the swim step assembly is at least partially hidden in the swim patio and a deployed position in which the swim step assembly extends downwardly from the swim patio in the open position for the person to climb into or out of the water, wherein the outer hull sidewall is pivotably coupled to the inner hull sidewall as a four-bar mechanism such that the outer hull sidewall is unhidden when the swim patio is in both the stowed position and the deployed position.

* * * * *